US005875800A

United States Patent [19]

Hulskotte

[11] Patent Number: 5,875,800

[45] **Date of Patent: *Mar. 2, 1999**

[54] DEVICE FOR CLEANING UTENSILS AND REMOVABLE CHAMBER INTO WHICH THE UTENSILS ARE DISPOSED

[76] Inventor: Jan Hendrik Hulskotte, Kloppendijk 52, NL-7591 BT Denekamp, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 793,488

[22] PCT Filed: Aug. 29, 1995

[86] PCT No.: PCT/EP95/03398

§ 371 Date: Mar. 27, 1997

§ 102(e) Date: Mar. 27, 1997

[87] PCT Pub. No.: WO96/06691

PCT Pub. Date: Mar. 7, 1996

[30] Foreign Application Priority Data

Aug. 30, 1994 [EP] European Pat. Off. ..... 94113537

[51] Int. Cl.[6] ..... A47L 15/18; A47L 15/42

[52] U.S. Cl. ..... 134/56 R; 134/80; 134/92; 134/95.3; 134/134; 134/144; 134/152; 134/153; 134/170

[58] Field of Search ..... 134/50, 54, 55, 134/88, 92, 95.3, 103.2, 170, 191, 198, 199, 200, 49, 79, 80, 82, 83, 134, 144, 152, 153, 155, 157, 158, 165, 56 R, 56 D, 57 R, 57 D; 206/553

[56] References Cited

U.S. PATENT DOCUMENTS

| | | | |
|---|---|---|---|
| 1,048,885 | 12/1912 | Risser | 134/152 X |
| 2,574,069 | 11/1951 | Stanley | 134/152 X |
| 2,712,826 | 7/1955 | Schleyer et al. | 134/148 X |
| 2,893,410 | 7/1959 | Frekko | 134/144 |
| 3,587,597 | 6/1971 | Courtney et al. | 134/170 X |
| 3,739,791 | 6/1973 | Fry et al. | 134/170 X |
| 3,879,787 | 4/1975 | Russo | 134/200 X |
| 4,420,003 | 12/1983 | Lee et al. | 134/134 X |
| 4,422,466 | 12/1983 | Schafer | 134/170 X |
| 4,456,022 | 6/1984 | Roberts | 134/153 X |
| 4,702,777 | 10/1987 | Kulh | 134/153 X |
| 5,038,809 | 8/1991 | Rodgers et al. | 134/111 |
| 5,133,374 | 7/1992 | Druding et al. | 134/104.2 |

FOREIGN PATENT DOCUMENTS 4014091 11/1991 Germany .

*Primary Examiner*—Philip R. Coe
*Attorney, Agent, or Firm*—Jordan and Hamburg, LLP

[57] ABSTRACT

A cleaning device for cutlery, includes a cleaning chamber with a spraying device acting in the cleaning chamber, the cleaning chamber being disposed so that it can be removed from the cleaning device. Also in a method for cleaning and disinfecting cutlery, the disinfecting and the cleaning are carried out consecutively in this or in the reverse order in the same cleaning chamber.

13 Claims, 4 Drawing Sheets

DEVICE FOR CLEANING UTENSILS AND REMOVABLE CHAMBER INTO WHICH THE UTENSILS ARE DISPOSED

BACKGROUND OF THE INVENTION

The invention relates to a device for cleaning cutlery.

Professionally used cutlery, such as knives used in slaughterhouses, must be cleaned frequently. For example, some of the knives, used in slaughterhouses, must be cleaned and disinfected at two-hour intervals. Previously, these knives were cleaned either by immersing them in containers of hot water or washing them off with hot water, or by using certain washing machines, for which purpose the knives, which were to be cleaned, were placed in baskets.

It is obvious that cleaning by immersing the individual knives or washing them off is time consuming and can easily lead to injuries. On the other hand, the purchase of dishwashing machines, which can be used professionally, is expensive and, on the way from the machine to the workplace, for example, in the slaughterhouse, the cleaned and disinfected knives may be soiled once again, so that they no longer meet the requirements of hygiene.

It is a further disadvantage of the cleaning devices and the cleaning methods, described above and previously known, that the cleaning and the disinfecting cannot be carried out in the same container and that, instead, two different pieces of equipment or containers are required for this purpose. This is first of all inconvenient and, on the other hand, the space required, for example, for two containers or two washing machines, is a disadvantage in slaughterhouses, in which space frequently is tight.

SUMMARY OF THE INVENTION

It is therefore an object of the invention to simplify the cleaning and/or disinfecting of cutlery, particularly in the industrial sector.

The cleaning chamber, known from cleaning equipment, is not connected in a stationary manner with the dishwashing machine and is instead detachably disposed at the cleaning equipment, so that it can be taken together with the cleaned cutlery to the workplace in such a manner that the cutlery cannot become soiled on the way.

In accordance with the above and other objects of the invention, there is provided an apparatus for cleaning utensils comprising a cleaning chamber in which the utensils are received, a cleaning fluid dispenser within the cleaning chamber for dispensing fluid to clean the utensils within the cleaning chamber, and a cleaning device having an outer container into which the cleaning chamber is removably disposed. The cleaning chamber and the outer container define an inner space between the cleaning chamber and the outer container. The cleaning device includes conduit means for delivering fluid to the cleaning fluid dispenser, and fluid discharge means for discharging fluid into the inner space to clean an outer surface of the cleaning chamber.

Further in accordance with the invention, there is provided an apparatus for cleaning utensils comprising a cleaning chamber in which the utensils are received, a cleaning fluid dispenser within the cleaning chamber for dispensing fluid to clean the utensils within the cleaning chamber, and a cleaning device having an outer container into which the cleaning chamber is removably disposed. The cleaning device includes conduit means for delivering fluid to the cleaning fluid dispenser, the conduit means including a valve, the cleaning device also includes a pump for supplying cleaning fluid to the conduit means. The cleaning chamber has the cleaning fluid dispenser fixedly disposed therein. The cleaning fluid dispenser includes a valve opening device for opening the valve when the cleaning chamber is disposed in the outer container to communicate the fluid from the conduit means to the cleaning fluid dispenser, and the valve is operable to automatically close by pressure of the fluid in the conduit means when the cleaning chamber is removed from the outer container.

Still further in accordance with the invention, there is provided an apparatus for cleaning utensils comprising a cleaning chamber in which the utensils to be cleaned are received, a cleaning fluid dispenser disposed in the cleaning chamber for cleaning the utensils within the cleaning chamber, a cleaning device having an outer chamber into which the cleaning chamber is disposed, the cleaning chamber being removable from the cleaning device. The cleaning chamber is surrounded by and spaced from the outer chamber to thereby define an inner space between the cleaning chamber and the outer chamber. A fluid discharge device is disposed in the inner space for discharging fluid to clean an outer surface of the cleaning chamber. The cleaning device includes a container for containing a cleaning solution and conduit means for conducting the cleaning solution from the container to the fluid discharge means for discharging the cleaning solution into the inner space to clean the outer surface of the cleaning chamber.

Still further in accordance with the invention, there is provided an apparatus for cleaning items comprising a cleaning chamber which includes an inner compartment surrounded by and spaced from an outer compartment to thereby define an inner space between the inner compartment and the outer compartment, the items to be cleaned being disposed in the inner compartment and in the inner space, cleaning fluid dispenser in the cleaning chamber for cleaning the items in the inner compartment and in the inner space, and a cleaning device on which the cleaning chamber is disposed, the cleaning chamber being removable from the cleaning device.

Still further in accordance with the invention, there is provided a cleaning device for utensils comprising a cleaning chamber having a utensils holder disposed therein and a bottom defining a bottom aperture, a substructure having a carrying plate rotatably disposed thereon, a holding device for removably holding the cleaning chamber on the carrying plate, a tunnel superstructure is disposed above a portion of the carrying plate such that the cleaning chamber passes through the tunnel superstructure as the carrying plate is rotated. The carrying plate defines a carrying plate opening disposed aligned with the bottom aperture of the cleaning chamber when held by the holding device. A spray head is disposed below the tunnel superstructure at a position alignable with the carrying plate opening when the carrying plate is rotated to dispose the cleaning chamber within the tunnel superstructure such that the spray head is disposed for introducing liquid into the cleaning chamber via the carrying plate opening and the bottom aperture of the cleaning chamber.

An example of the invention is described in the following by means of the accompanying drawings.

DESCRIPTION OF THE PREFERRED EMBODIMENTS

Figure 1:
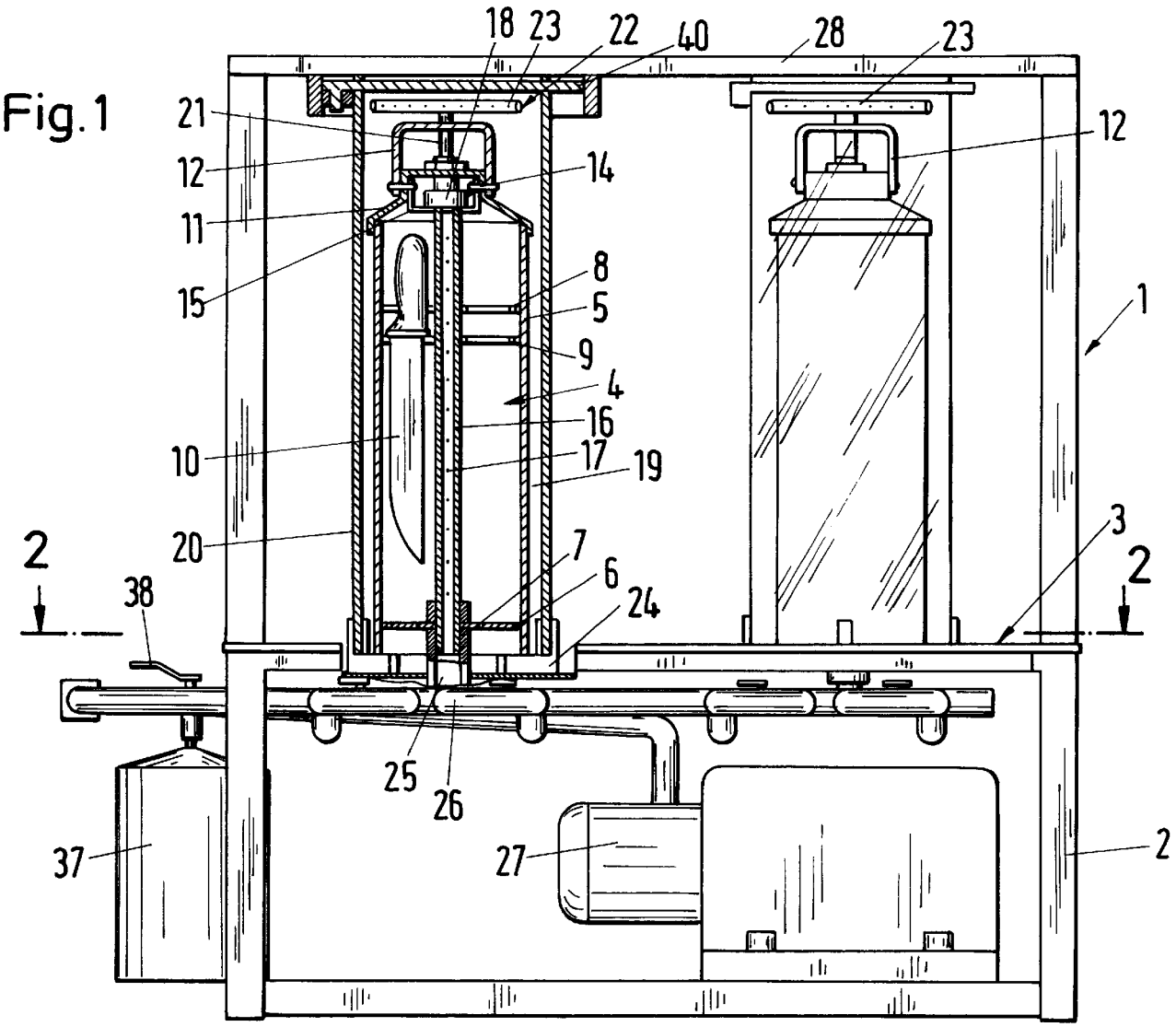
FIG. 1 shows a view of the cleaning equipment.

In FIG. 1, a cleaning device 1 is shown, which has a frame 2, which carries a tub 3, on which, in turn, two cleaning chambers 4 are disposed. Of course, the number of cleaning chambers 4 disposed on the tub 3 can be varied as required.

The cleaning chamber 4 has a wall 5, which is cylindrical in this example and has, in the lower region, a base plate 6, which has discharging openings 7. Furthermore, there is a cutlery guide 8 in the cleaning chamber 4 and, below the cutlery guide 8, a cutlery holder 9, which securely accommodates the cutlery to be cleaned, which in this case consists of knives 10, and prevents mutual contact of the cutlery to be cleaned.

In the upper region of the cleaning chamber 4, there is a closing lid 12, at which a handle 11 is disposed in such a manner that it can be pivoted over a joint 14, the pivotal motion of the handle 12 being transferred to a closing mechanism 15, which reaches into the interior of the cleaning chamber 4.

In the interior of the cleaning chamber 4, a riser tube 16 is disposed, which has spray nozzles 17 at its outer periphery. In the upper region, the riser tube 16 has a reinforcement 18, behind which the closing mechanism 15 grips in the closed state.

The cleaning chamber 4 is surrounded by a rinsing chamber 19, which in this example once again has a cylindrical shape. Between the wall 5 of the cleaning chamber 4 and a wall 20 of the rinsing chamber, a second riser tube 21 is disposed, which has rinsing devices 22 in the upper region, a rinsing arm 23 being constructed essentially semicircularly and having nozzles. A closing lid 40 is provided on the rinsing chamber 19.

The cleaning chamber 4 stands on spacers 24, which in turn are held on the tub 3. The riser tube 16 is connected in the lower region with a valve 25, which is also connected with a feed line, which in turn is connected with a pump 27. The valve 25 has a ball which, when the cleaning chamber 4 is taken off, closes the outlet opening of the valve 25 by the pressure produced by the pump 27. If the cleaning chamber 4 is placed on the tub 3, so that the riser tube 16 protrudes into the valve 25, the ball of the valve is moved by the lower end of the riser tube 16 out of its closed position and flow of the liquid is enabled.

A tank 37 for the disinfecting liquid is also shown in FIG. 1.

In its upper region, the frame 2 has a stabilizing lid 28, by means of which the cleaning chambers 4, disposed on the tub 3, are fixed additionally securely in their position.

Figure 2:
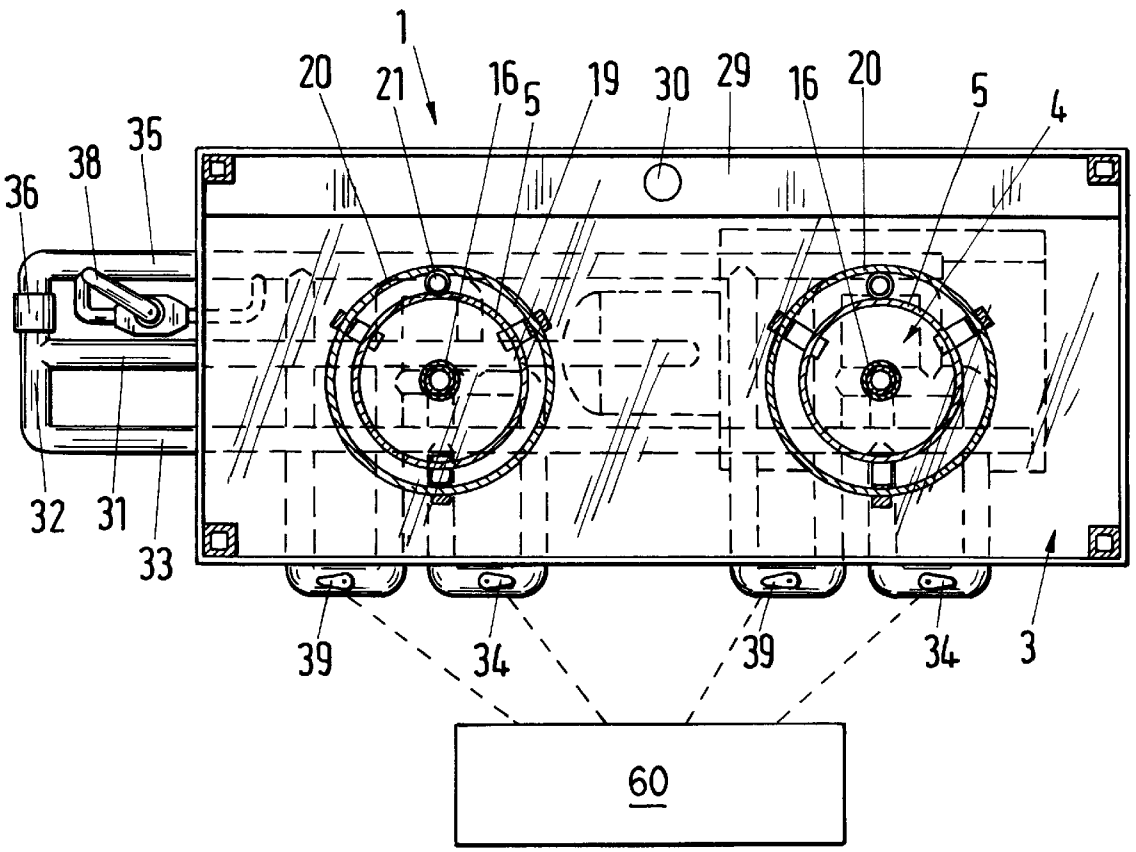
FIG. 2 shows a plan view corresponding to the line 2—2 of FIG. 1.

The view along the line 2—2 of FIG. 1 is shown in FIG. 2. The cleaning chamber 4 with the riser tube 16, as well as the rinsing chamber 19 with the second riser tube 21 are shown. At one end, the tub 3 has an outlet trough 29, which in turn has an outlet 30 for the rinsing liquid that has been consumed.

Furthermore, pipelines, by means of which the riser tube 16 and the second riser tube 21 are supplied, can be recognized below the tub 3. A main pipeline 31 leads from the pump 27 to a manifold 32, from which a rinsing water pipeline 33 branches off, The supply of rinsing water to the cleaning chamber 4 and the rinsing chamber 19 can be controlled by a stopcock 34. Furthermore, a disinfectant pipeline 35, which has a check valve 36, branches off from the manifold 32. The disinfectant pipeline 35 has a bypass channel, to which the disinfectant tank 37 is connected. The bypass channel can be opened and closed by a lever 38. The cleaning chamber 4 and the rinsing chamber 19 can now be supplied with disinfectant solution by opening a stopcock 39. Cleaning fluid and disinfectant solution are supplied in a similar manner to the cleaning chamber 4, which is furthermore shown.

Figure 3:
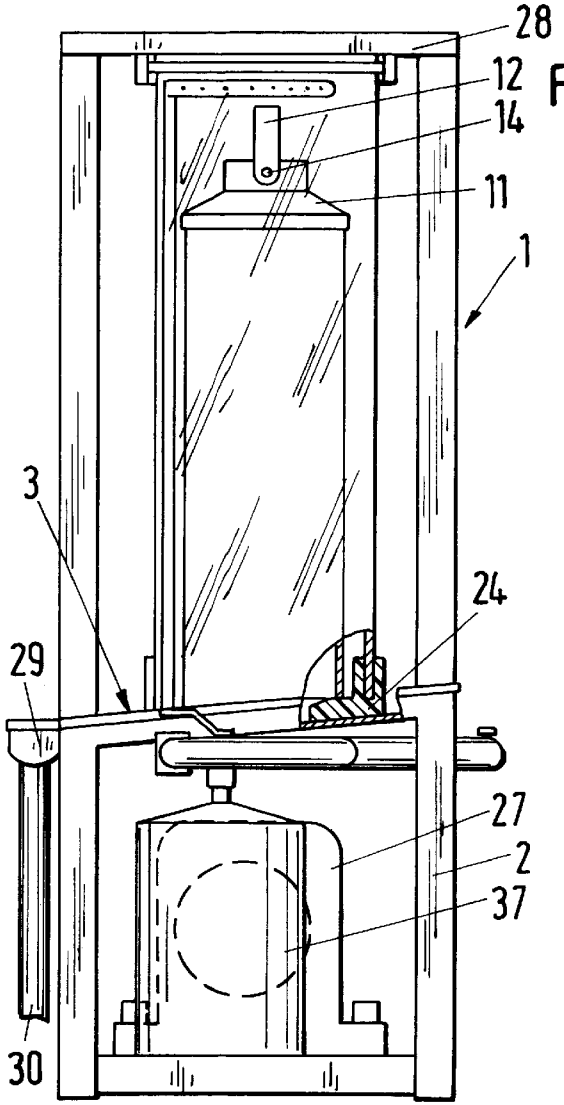
FIG. 3 shows a side view of the cleaning equipment.

Finally, in FIG. 3, a side view is shown, from which it becomes clear that the tub 3 is inclined towards the side, at which there is the discharge trough 29 as well as the drain 30.

If the knives used, for example, in a slaughterhouse, are to be cleaned, they are suspended directly at the workplace in the cleaning chamber 4, which has been removed from the cleaning device 1. For this purpose, the handle of the knife 10 lies on the cutlery holder 9, while the cutlery guide 8 ensures that the knife is guided securely, so that the knives, for example, cannot touch one another. After that, the lid 11 is placed down on the wall 5 and the handle 12 is folded upwards, so that the closing mechanism 15 grips behind the reinforcement 18 of the riser tube 16. The cleaning chamber 4 can then be carried simply to the cleaning device 1. Even if many knives are transported, the danger of injury to the operating personnel is precluded.

The cleaning chamber 4 is now inserted into the rinsing chamber 19, which is already disposed on the tub 3. Before the lid 40 of the rinsing chamber is closed, a metal glove, which is common use in slaughterhouses, is suspended from the rinsing arm in such a manner, that the fingers of the metal glove point downwards and the rinsing solution is sprayed into the glove, so that the metal glove is cleaned from the inside to the outside.

This is a further advantage of the invention, since metal gloves previously had to be cleaned laboriously, for example, with a hose.

After the lid 40 is closed, the stopcock 39 is opened in order to disinfect the knives in the cleaning chamber 4. The disinfecting solution, which is under pressure, rises in the riser tube 16 and is passed through the spray nozzles 17 into cleaning chamber 4 and thus ensures a wetting of the knives 10 with the solution and, with that, disinfects the knives. The disinfecting solution also rises in the second riser tube 21 and is sprayed over the spraying arm 23 within the rinsing chamber 19, so that the cleaning chamber 4 is also disinfected from the outside. When a metal glove is suspended over the rinsing arm 23, it is of course, also disinfected. By closing the stopcock 39, the supply of disinfecting solution is shut off. There can now be a period of action, as required. After that, the stopcock 34 is opened and cleaning solution is introduced into the two chambers 4 and 19. Of course, it is also possible to carry out only the disinfecting or only the cleaning with the proposed cleaning device 1 or to proceed in a sequence, which is the reverse of that described above.

Within the cleaning chamber 4, the discharging rinsing solution and disinfecting solution run through the drain openings 7 into the tub 3. Because of the slope of the tub 3, the effluent flows through the discharging trough 29 into the outlet 30 and can be disposed of appropriately. The solutions from the rinsing chamber, which are no longer required, are also discharged through the discharging trough 29 and the outlet 30.

After the knives 10 have been cleaned, the cleaning chamber 4 is once again removed from the cleaning device 1. Even if the stopcock 34 or the stopcock 39 has not been shut off due to an oversight, liquid will not emerge from the pipeline 26, since the valve 25 is in a closed position when the cleaning chamber 4 is removed. The removed cleaning chamber 4, which was also disinfected on the outside, can also be carried, for example, through the slaughterhouse up to the appropriate workplace, without the risk that the freshly cleaned knives can be contaminated once again, for example, by sprayed blood.

The invention described also has the advantage that the knives 10, used and soiled at the workplace, can be inserted directly into the cleaning chamber 4 at hand, without having to be stored provisionally in boxes or the like, which can lead to injuries due to inattentiveness. Of course, the invention is not limited to the embodiment described. For example, it is also possible, for example, to use many cleaning chambers 4 on one cleaning device 1. Furthermore, it is also possible that for example, only a cleaning solution is passed into the cleaning chamber 4 or that connections are provided, so that more than the two solutions described are passed into the cleaning chamber. In order to achieve particularly economic cleaning of cutlery, the manual handling of the stopcocks 39 and 34 may be omitted, for example, in large plants and the introduction of cleaning liquids may optionally be controlled by a computer 60.

In order to make particularly intensive cleaning of the knives or the cutlery possible, the riser tube 16 may also be disposed rotatably in the cleaning chamber, so that the spray nozzles 17 graze the cleaning chamber 4 as they rotate.

Figure 4:
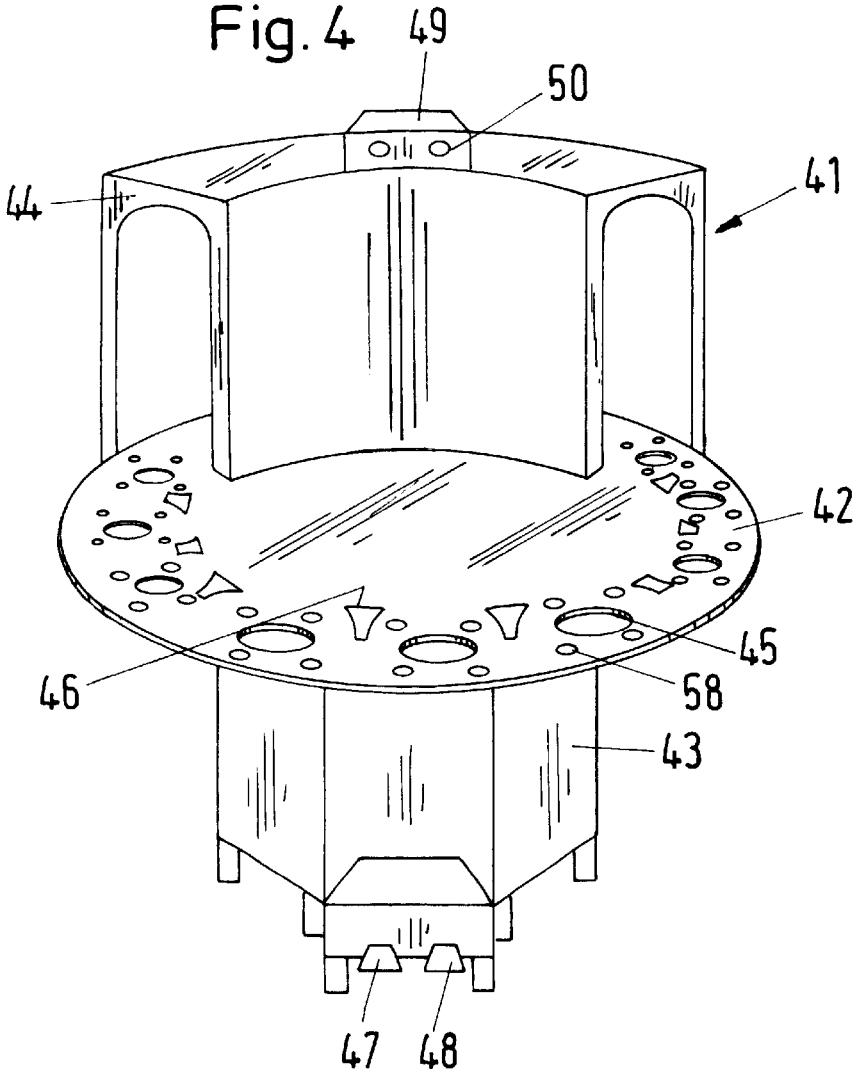
FIG. 4 shows a complete view of automatic cleaning equipment with dismountable cleaning chambers.

FIG. 4 shows automatic knife-cleaning and knife-disinfecting equipment 41, which comprises essentially a round carnning plate 42, a substructure 43 and a tunnel-like superstructure 44.

The carrying-plate 42 has openings 45, the cleaning chambers 4 being set down on the openings 45. Centering blocks 46 are placed on the carrying plate 42, in order to enable the cleaning chambers 4, which have been set down, to be held securely.

The carrying plate 42 is constructed rotatably, so that the cleaning chambers 4, which have been set down in the front region of the carrying plate 42, reach the tunnel-like superstructure 44 due to a rotation of the carrying plate 42. Two pedals 47, 48 are disposed on the substructure 43, pressure on the pedal 47 resulting in the rotation of the carrying plate 42 in order to equip this carrying plate 42 with cleaning chambers 4. It is advantageous if, when pressure is exerted on pedal 47, the carrying plate 42 carries out half a revolution, so that initially, for example, the front region of the carrying plate 42 can be equipped with cleaning chambers 4 and that thereafter, after the pedal 47 is actuated, this equipped region, through rotation of the carrying plate 42, reaches the region of the superstructure 44 at the rear, and the region of the carrying plate 42, which must still be equipped, is rotated towards the operator.

The automatic equipment 41 is started by actuating the pedal 48.

In a housing 49 on the superstructure 44, there is a nozzle for cleaning the outside of the cleaning chamber 4. The operating state of the equipment 41 is indicated by control lamps 50. When both lights 50 are on, the equipment 41 is carrying out the first rinsing process, that is, water with cleaning agents and disinfectants is sprayed into the cleaning chamber 4. Only one lamp 50 is lit during the second rinsing process with water only.

Figure 5:
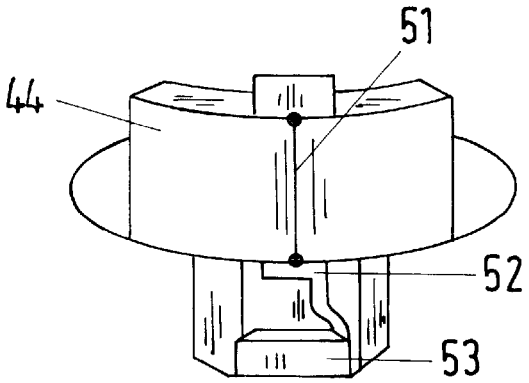
FIG. 5 shows a rear view of such cleaning equipment.

FIG. 5 shows a rear view of the equipment 41 with a supply pipeline 51, which connects a lower and an upper nozzle. Furthermore, there is a drain 52 for collecting and discharging used rinsing and cleaning water or disinfectant. A pump 53 produces the pressure on the water and the disinfectant, required for the rinsing and disinfecting.

Figure 6:
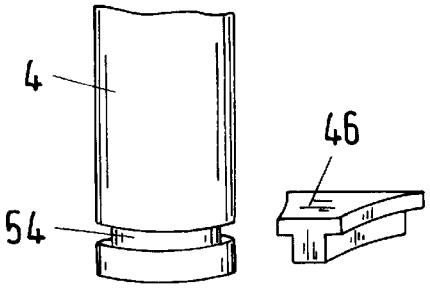
FIG. 6 shows a removable cleaning chamber with a centering block in detail.

FIG. 6 diagrammatically shows the lower part of a cleaning chamber 4. This chamber is cylindrical and, in the lower region, has a recess 54, the dimensions of which correspond to the protruding edge of the centering block 46. If now the cleaning chamber 4 is placed on the carrying plate 42, the cleaning chamber 4 is pushed so far against the centering blocks 46, that the edges of the centering blocks 46 engage the recess 54 or the groove of the cleaning chamber 4. By these means, it is ensured that the cleaning chambers 4 are held securely on the carrying plate 42.

Figure 7:
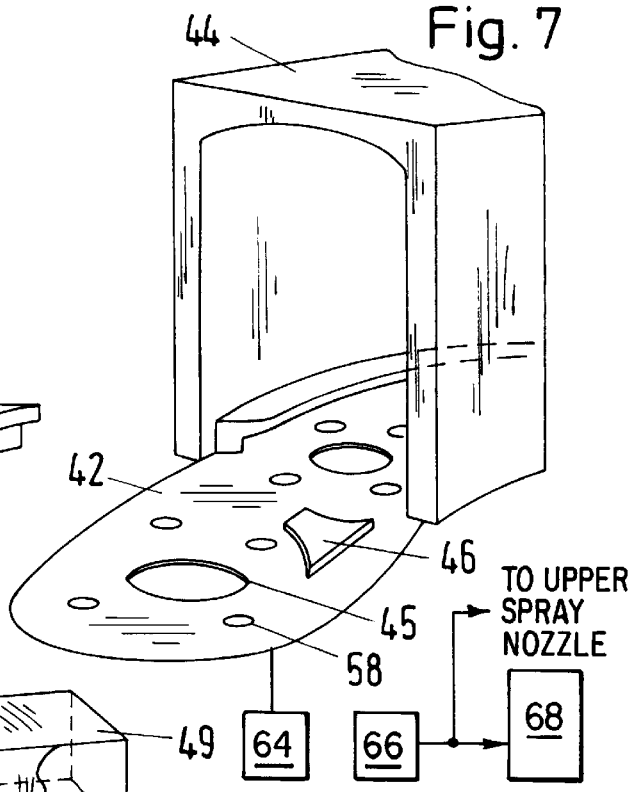
FIG. 7 shows a carrying plate and part of the housing of the cleaning equipment in section.

As is evident from FIG. 7, there is in the interior of the superstructure 44 a spring contact strip 55, which is of such a size and disposed in such a manner, that it engages the recess 54 of the cleaning chamber 4, when the cleaning chamber 4, standing on the carrying plate 42, reaches the superstructure 44 due to the rotation of the carrying plate 42. The cleaning chamber 4 is secured against accidents by these means in the front as well as in the rear region.

Figure 8:
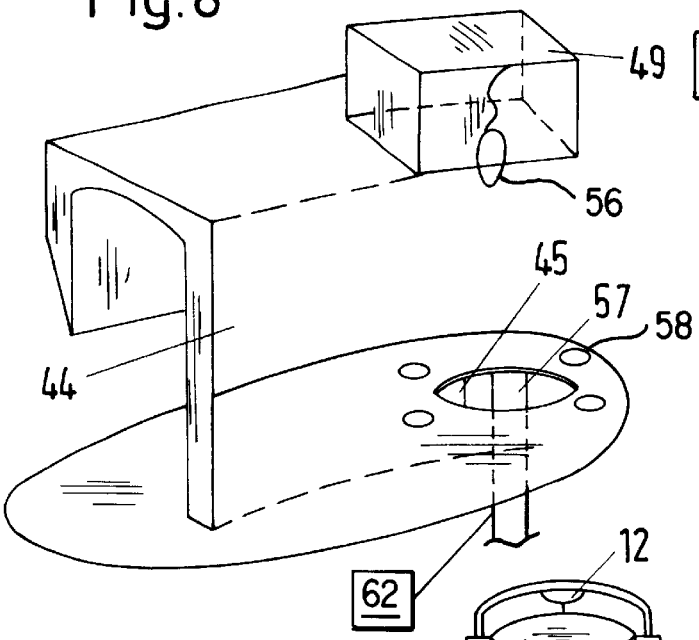
FIG. 8 shows part of the cleaning equipment in section.

FIG. 8 diagrammatically shows an upper injection nozzle 56, which is in the region of the housing 49 and cleans the outside of the cleaning chambers 4 from above. A spray head 57, which is located below the carrying plate 42 and from which water and disinfectant solution are sprayed when the cleaning chamber 4 is above the spray head 57, is shown diagrammatically. During the cleaning process, drive means 62 move the spray head 57 vertically up and down and into the cleaning chamber 4 in order to make it possible to clean equipment in the cleaning chamber 4 particularly intensively. At the same time, most of the effluent runs off through the openings 45. Additional water, such as that from the cleaning of the outside of the cleaning chamber 4, runs off through the outlet openings 58.

Figure 9:
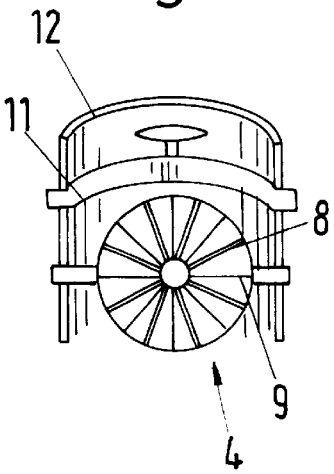
FIG. 9 shows the cleaning chamber in plan view.

In FIG. 9, an opened cleaning chamber 4 is shown from above. The opened lid 11, folded over to the side, and the handle 12 are shown clearly. The cutler guides 8 and cutlery holders 9 are shown diagrammatically in the interior of the cleaning chamber 4. By these means, the knives, which are to be cleaned, can simply be inserted into the cleaning chamber 4, kept there without any problems until they are to be cleaned without representing a safety risk and subsequently transported with the cleaning chamber 4 in order to be cleaned.

Figure 10:
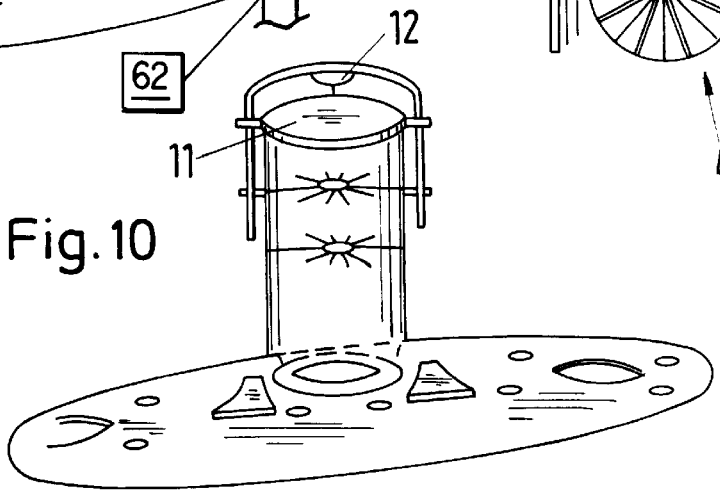
FIG. 10 shows a sectional representation of the cleaning chamber, disposed on the carrying plate.

FIG. 10 is a sectional representation of the cleaning chambers 4 with a closed lid 11, standing on the carrying plate 42.

Below the carrying plate 42, metal contacts 64 are disposed, which are acted upon by a sensor 66 disposed below the carrying plate 42. The carrying plate 42 is driven by a motorized driving mechanism 68 in accordance with information from the sensor 66, that is, whenever an opening 45 is below the spray head 57, the driving mechanism 68 of the carrying plate 42 stops and the spray head 57 can now clean the cleaning chamber 4 above. The information from the sensor 66 is furthermore passed on to the upper spray nozzle 56, which also cleans the outside of the cleaning chamber 4, when the cleaning chamber 4 is in the appropriate position below the upper spray nozzle 56.

Of course, the carrying plate 42 can also be cycled in a different manner, for example, by sensors disposed differently, by optical signals, etc.

When they have been cleaned, the cleaned cleaning chambers 4 are removed from the carrying plate 42. Here also, the pedal 47 makes it possible to remove all cleaning chambers 4 easily from the carrying plate 42.

What is claimed is:

1. A cleaning device for utensils comprising:

a cleaning chamber having a utensils holder disposed therein and a bottom defining a bottom aperture;

a substructure having a carrying plate rotatably disposed thereon;

a holding device for removably holding said cleaning chamber on said carrying plate;

a tunnel superstructure is disposed above a portion of said carrying plate such that said cleaning chamber passes through said tunnel superstructure as said carrying plate is rotated;

the carrying plate defining a carrying plate opening disposed aligned with said bottom aperture of said cleaning chamber when held by said holding device;

a spray head disposed below said tunnel superstructure and said carrying plate at a position alignable with said carrying plate opening when said carrying plate is rotated to dispose said cleaning chamber within said tunnel superstructure such that said spray head is disposed for introducing liquid into said cleaning chamber via said carrying plate opening and said bottom aperture of said cleaning chamber.

2. The cleaning device of claim 1, further comprising means for moving said spray head vertically up and down, respectively into and out of said cleaning chamber through said carrying plate opening and said bottom aperture of said cleaning chamber.

3. The cleaning device according to claim 2, further comprising a driving mechanism for rotating said carrying plate with said cleaning chamber held thereon to align said bottom aperture of said cleaning chamber with said spray head.

4. The cleaning device according to claim 3, further comprising metal contacts and a sensor for detecting a position of said carrying plate and controlling said driving mechanism to align said bottom aperture of said cleaning chamber with said spray head.

5. The cleaning device according to claim 4, further comprising a nozzle for cleaning an outside of said cleaning chamber disposed in said tunnel superstructure.

6. The cleaning device according to claim 1, wherein said holding device includes said cleaning chamber having a recess and said carrying plate having at least one centering block disposed on an upper surface thereof for engaging said recess to center said cleaning chamber over said carrying plate opening.

7. The cleaning device of claim 6, further comprising a spring contact strip for biasing said cleaning chamber into engagement with said at least one centering block to prevent said cleaning chamber from tipping over.

8. The cleaning device according to claim 1, further comprising said carrying plate having outlet openings, adjacent said carrying plate opening, for draining liquid from said cleaning chamber.

9. The cleaning device according to claim 1, further comprising a driving mechanism for rotating said carrying plate with said cleaning chamber held thereon to align said bottom aperture of said cleaning chamber with said spray head.

10. The cleaning device according to claim 9, further comprising metal contacts and a sensor for detecting a position of said carrying plate and controlling said driving mechanism to align said bottom aperture of said cleaning chamber with said spray head.

11. The cleaning device according to claim 10, further comprising a nozzle for cleaning an outside of said cleaning chamber disposed in said tunnel superstructure.

12. The cleaning device according to claim 1, further comprising a nozzle for cleaning an outside of said cleaning chamber disposed in said tunnel superstructure.

13. The cleaning device of claim 12, further comprising means for moving said spray head vertically up and down, respectively into and out of said cleaning chamber through said carrying plate opening and said bottom aperture of said cleaning chamber.

* * * * *